US006111394A

United States Patent [19]

Casper

[11] Patent Number: 6,111,394

[45] Date of Patent: Aug. 29, 2000

[54] N-CHANNEL VOLTAGE REGULATOR

[75] Inventor: Stephen L. Casper, Boise, Id.

[73] Assignee: Micron Technology, Inc., Boise, Id.

[21] Appl. No.: 09/361,824

[22] Filed: Jul. 27, 1999

Related U.S. Application Data

[63] Continuation of application No. 09/228,342, Jan. 11, 1999, Pat. No. 5,936,388, which is a continuation of application No. 08/912,875, Aug. 15, 1997, Pat. No. 5,923,156.

[51] Int. Cl.[7] ..... G05F 1/56; G05F 1/10

[52] U.S. Cl. ..... 323/273; 327/538

[58] Field of Search ..... 323/273, 275, 323/279, 282, 285, 299, 303; 327/534, 535, 538, 540; 326/31, 33, 101

[56] References Cited

U.S. PATENT DOCUMENTS

| | | | |
|---|---|---|---|
| 4,748,350 | 5/1988 | Emori | 326/126 |
| 4,751,463 | 6/1988 | Higgs et al. | 323/314 |
| 4,823,070 | 4/1989 | Nelson | 323/285 |
| 4,906,913 | 3/1990 | Stanojevic | 323/303 |
| 5,159,206 | 10/1992 | Tsay et al. | 307/272.3 |
| 5,260,646 | 11/1993 | Ong | 323/349 |
| 5,384,498 | 1/1995 | Wong | 326/31 |
| 5,552,739 | 9/1996 | Keeth et al. | 327/538 |
| 5,552,740 | 9/1996 | Casper | 327/541 |
| 5,557,579 | 9/1996 | Raad et al. | 365/226 |
| 5,563,499 | 10/1996 | Pinney | 323/266 |
| 5,631,547 | 5/1997 | Fujioka et al. | 323/273 |
| 5,642,073 | 6/1997 | Manning | 327/536 |
| 5,644,215 | 7/1997 | Casper | 323/274 |
| 5,686,820 | 11/1997 | Riggio, Jr. | 323/273 |
| 5,945,818 | 8/1999 | Edwards | 323/273 |

*Primary Examiner*—Matthew Nguyen
*Attorney, Agent, or Firm*—Schwegman, Lundberg, Woessner & Kluth, P.A.

[57] ABSTRACT

A voltage regulator circuit for regulating an input voltage supply. The voltage regulator includes an n-channel transistor that has a gate and a source/drain region. The source/drain region of the transistor provides an output signal for the regulator circuit. The regulator circuit also includes a pull-up device that is coupled between a pumped voltage supply and a gate of the n-channel transistor. A pull-down device is also coupled between the gate of the n-channel transistor and ground potential. The voltage regulator also includes a level sensing circuit that is responsive to the gate of the n-channel transistor. The level sensing circuit generates a control signal for a control input of the pull-down device to provide feedback control of the n-channel transistor to regulate the output of the source/drain of the n-channel transistor.

36 Claims, 4 Drawing Sheets

N-CHANNEL VOLTAGE REGULATOR

This application is a Continuation of U.S. Ser. No. 09/228,342, filed Jan. 11, 1999, now U.S. Pat. No. 5,936, 388, which is a Continuation of U.S. Ser. No. 08/912,875, filed Aug. 15, 1997, now U.S. Pat. No. 5,923,156.

TECHNICAL FIELD OF THE INVENTION

The present invention relates generally to the field of electronic circuits and, in particular, to an n-channel voltage regulator.

BACKGROUND OF THE INVENTION

A semiconductor circuit or logic device may be designed for any of a wide variety of applications. Typically, the device includes logic circuitry to receive, manipulate or store input data, and the same or modified data is subsequently generated at an output terminal of the device. Depending on the type of logic device or the circuit environment in which the device is used, the device may include a regulator that provides an internal power signal that is independent of fluctuations of an external power signal.

A dynamic random access memory (DRAM), formed as an integrated circuit, is an example of such a semiconductor circuit or logic device having a regulator. Conventionally, the DRAM receives an external power signal ($V_{CCX}$) having a voltage intended to maintain a voltage level (or range), for example, of 5 volts measured relative to common or ground. Internal to the DRAM, the regulator maintains an internal power signal ($V_{CCR}$) at a designated level, for example, of 3.3 volts. Ideally, $V_{CCR}$ linearly tracks $V_{CCX}$ from zero volts to the designed level at which point $V_{CCR}$ remains constant as $V_{CCX}$ continues to increase in voltage or fluctuate above this level.

A number of previously implemented semiconductor power regulation circuits use a feedback-controlled p-channel transistor at the output of a control circuit, wherein the p-channel transistor is modulated once $V_{CCX}$ reaches the internal operating voltage level, at which point $V_{CCR}$ remains constant as described above. This approach is disadvantageous, however, because the feedback-controlled p-channel transistor acts in a manner similar to an operational amplifier whereby a substantial amount of current may be consumed during normal operation.

One known approach for mitigating this problem is to implement the control circuit at the input of the p-channel transistor with a low-power standby mode. In this mode, the larger p-channel transistor is deactivated when the integrated circuit is not in use so as to limit the excessive drain of drive current by the feedback-controlled p-channel transistor. Despite this limitation on current consumption, it is still desirable to reduce the overall level of current consumption. This is especially true for integrated circuit applications in which the integrted circuit is seldom not in use, in which case the beneficial contribution of the standby mode is nominal at best. Moreover, the standby approach introduces a delay to the operation of the integrated circuit, for example, during the transition from standby to normal operation. For fast-responding integrated circuits, such an additional delay is undesirable and often unacceptable.

U.S. Pat. No. 5,552,740 (the Casper patent) issued to Stephen L. Casper on Sep. 3, 1996 and is assigned to Micron Technology, Inc. The Casper patent describes an alternative to the more conventional feedback-controlled p-channel transistor-based regulator. Specifically, Casper describes a power-efficient power regulation circuit for use in semiconductor circuits powered by a power signal. The power regulation circuit includes an n-channel transistor which provides a regulated power signal having a stabilize voltage level for use by the semiconductor circuit. A bias pull-up circuit is coupled to the gate of the n-channel transistor and arranged for biasing the n-channel transistor so that it normally conducts current. A resistive circuit, including a resistive element arranged in series with a resistor-arranged p-channel transistor, is coupled to a source of the n-channel transistor and, in response to the regulated power signal, provides a feedback-control signal. A voltage control circuit, coupled to the bias pull-up circuit and the resistive circuit, is activated to control the n-channel transistor in response to the feedback control signal.

The power regulation circuit described in the Casper patent provides a regulated output voltage that tracks the external voltage as the external voltage increases. Unfortunately, at low voltage, the regulated output voltage of the power regulation circuit trails behind the external voltage by approximately one threshold voltage, $V_T$, of the n-channel transistor. This is not a problem provided that the operating voltage for the integrated circuit is sufficiently high. However, industry trends are to continue to reduce the operating voltage of integrated circuits. Thus, as the operating voltage is reduced, this inherent lag between the regulated voltage and the external voltage may cause problems with the operation of the semiconductor circuit that uses the output of the regulator.

FIG. 1 is a schematic diagram of an improvement of the voltage regulator of the Casper patent. Voltage regulator 100 includes n-channel output transistor 102 that is coupled to produce the regulated voltage labeled $V_{CCR}$ at a source/drain region of transistor 102. Regulator 100 further includes n-channel transistor 104 that includes a gate that is coupled to the gate of transistor 102. Transistors 102 and 104 each include a source/drain region that is coupled to an external voltage supply labeled $V_{CCX}$. A second source/drain region of transistor 104 is coupled to level sensing circuit 106. Level sensing circuit 106 includes p-channel transistor 108 and voltage divider 110. Transistor 108 includes a first source/drain region that is coupled to the source/drain region of transistor 104. Transistor 108 also includes a gate that is coupled to ground Voltage divider 110 is coupled between the second source/drain region of transistor 108 and ground.

Regulator 100 also includes n-channel transistor 112 that is coupled as a pull-down device in a feedback path to the gates of transistors 104 and 102. A gate of transistor 112 is coupled to an output of voltage divider 110 at node B. A first source/drain region of transistor 112 is coupled to ground. A second source/drain region of transistor 112 is coupled to the gates of transistors 102 and 104 to provide a reference voltage labeled $V_{REF}$ which is used to regulate the output of transistor 102.

Regulator 100 further includes feedback shut-off circuit 114. Circuit 114 includes voltage divider 116 that is coupled between $V_{CCX}$ and $V_{REF}$. Circuit 114 further includes p-channel transistor 118 with a control gate coupled to an output of voltage divider 116. P-channel transistor 118 further includes a first source/drain region that is coupled to $V_{CCX}$. Circuit 114 also includes n-channel transistors 120 and 122. Transistor 120 is a long-L transistor. A first source/drain region of transistor 120 is coupled to a second source/drain region of transistor 118 at node A. A second source/drain region of transistor 120 is coupled to ground and a gate of transistor 120 is coupled to $V_{CCX}$. A gate of transistor 122 is coupled to node A. A first source/drain region of transistor 122 is coupled to ground and a second source/drain region of transistor 122 is coupled to the gate of transistor 112 at node B.

The improvement in regulator 100 is in the incorporation of feedback shut-off circuit 114 which turns off the feedback path of regulator 100 at voltage levels corresponding to a "burn-in" mode for the semiconductor circuit. In the burn-in mode, $V_{CCX}$ reaches a voltage level that causes sufficient current in voltage divider 116 so as to turn on transistor 118. Since transistor 120 is a long-L transistor, transistor 118 is able to overcome the effect of transistor 120 on node A and bring node A to a high potential so as to turn on transistor 122. When transistor 122 is turned on, node B is brought to approximately ground potential so as to turn off transistor 112 and thereby disconnect the feedback to transistors 102 and 104. By disconnecting the feedback path, the output of transistor 102 is more easily able to track increases in the external voltage $V_{CCX}$. However, at low voltages, improved regulator 100 also produces the characteristic lag between $V_{CCX}$ and $V_{CCR}$ at low voltages.

For the reasons stated above, and for other reasons slated below which will become apparent to those skilled in the art upon reading and understanding the present specification, there is a need in the art for a power regulation circuit that tracks the external voltage at low voltages.

SUMMARY OF THE INVENTION

The above mentioned problems with power regulators and other problems are addressed by the present invention and which will be understood by reading and studying the following specification. An n-channel regulator is described which uses a pumped voltage supply in combination with the external voltage to overcome a drop in voltage between the external voltage and the regulated voltage.

In particular, an illustrative embodiment of the present invention includes a voltage regulator circuit for regulating an input voltage supply. The voltage regulator includes an n-channel transistor that has a gate and a source/drain region. The source/drain region of the transistor provides an output signal for the regulator circuit The regulator circuit also includes a pull-up device that is coupled between a pumped voltage supply and a gate of the n-channel transistor. A pull-down device is also coupled between the gate of the n-channel transistor and ground potential. The voltage regulator also includes a level sensing circuit that is responsive to the gate of the n-channel transistor. The level sensing circuit generates a control signal for a control input of the pull-down device to provide feedback control of the n-channel transistor to regulate the output of the source/drain of the n-channel transistor.

In another embodiment, an integrated circuit is provided. The integrated circuit includes a functional circuit, a pumped voltage supply, and a voltage regulation circuit. The voltage regulation circuit receives an unregulated input voltage and provides a regulated output voltage to the functional circuit. The voltage regulation circuit includes an n-channel transistor with a control gate that is coupled to a pull-down circuit in a feedback loop. A pull-up circuit that is driven by a voltage from the pumped voltage supply is also included so as to allow the regulated voltage to match the level of the input voltage at low voltage levels.

In another embodiment, a method for regulating a voltage for an integrated circuit is provided. The method includes driving a control input of an n-channel transistor with an increasing control signal until the n-channel transistor produces a select voltage level. The method also includes generating a pumped voltage level from the output of the n-channel transistor. The n-channel transistor is driven with the pumped voltage so that the output of the n-channel transistor substantially matches the voltage level of the control signal at low voltages. Further, the method includes regulating the output of the n-channel transistor through a feedback path.

In another embodiment, a voltage regulator is provided. The voltage regulator includes an n-channel transistor having a control gate and a regulated output. The voltage regulator also includes a feedback loop that is coupled to the n-channel transistor. The feedback loop pulls down the voltage on the gate of the n-channel transistor to regulate the output of the voltage regulator over a range of input voltages. Finally, the voltage regulator includes a pull-up circuit coupled to the gate of the n-channel transistor. The pull-up circuit includes a pumped voltage supply that drives the n-channel transistor to match the level of the input voltage at voltage levels below the operating voltage of an integrated circuit that uses the voltage regulator.

DETAILED DESCRIPTION OF THE INVENTION

In the following detailed description, reference is made to the accompanying drawings which form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Figure 1:
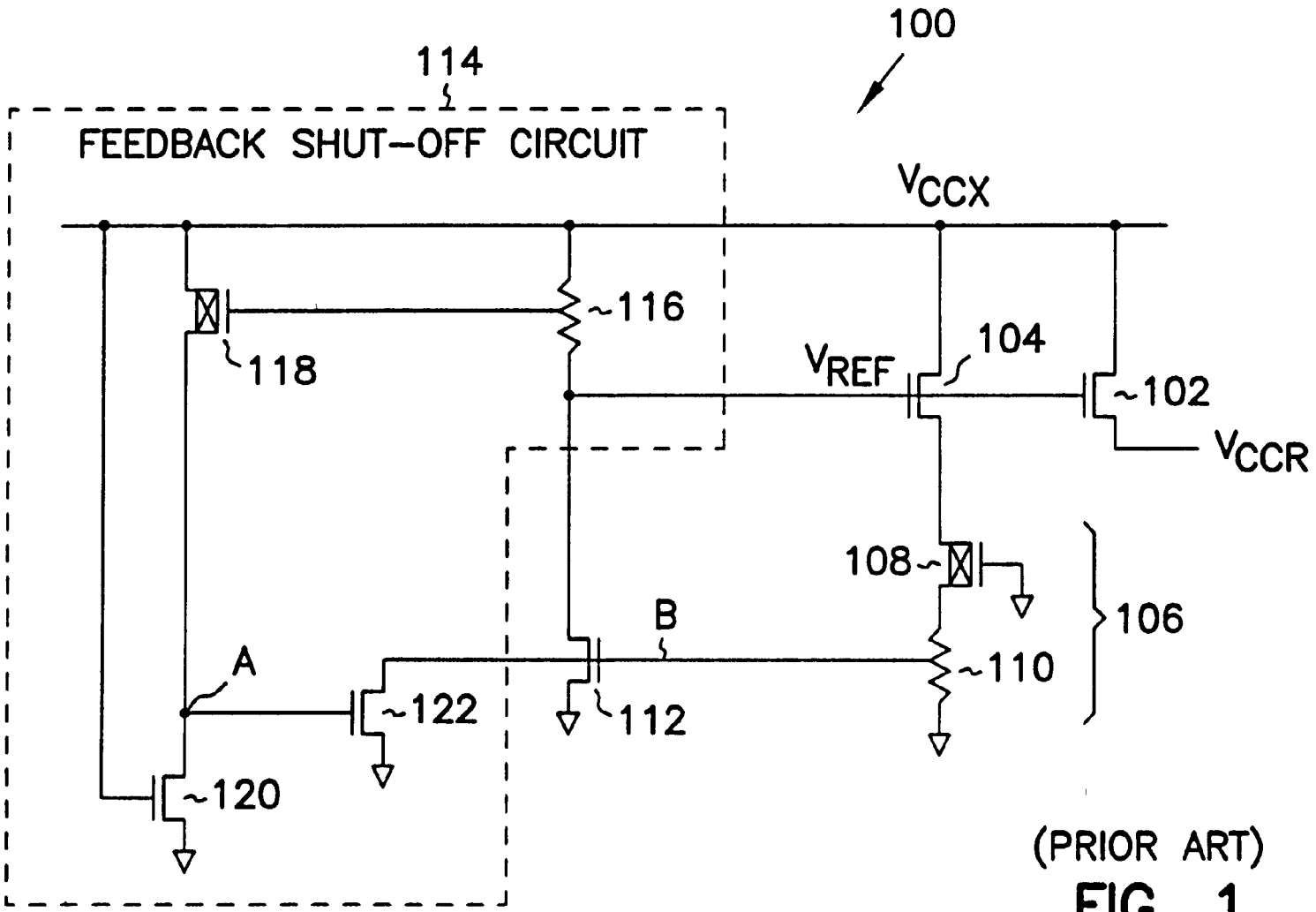
(PRIOR ART) FIG. 1
FIG. 1 is a schematic diagram of a voltage regulator in the prior art.
Figure 2:
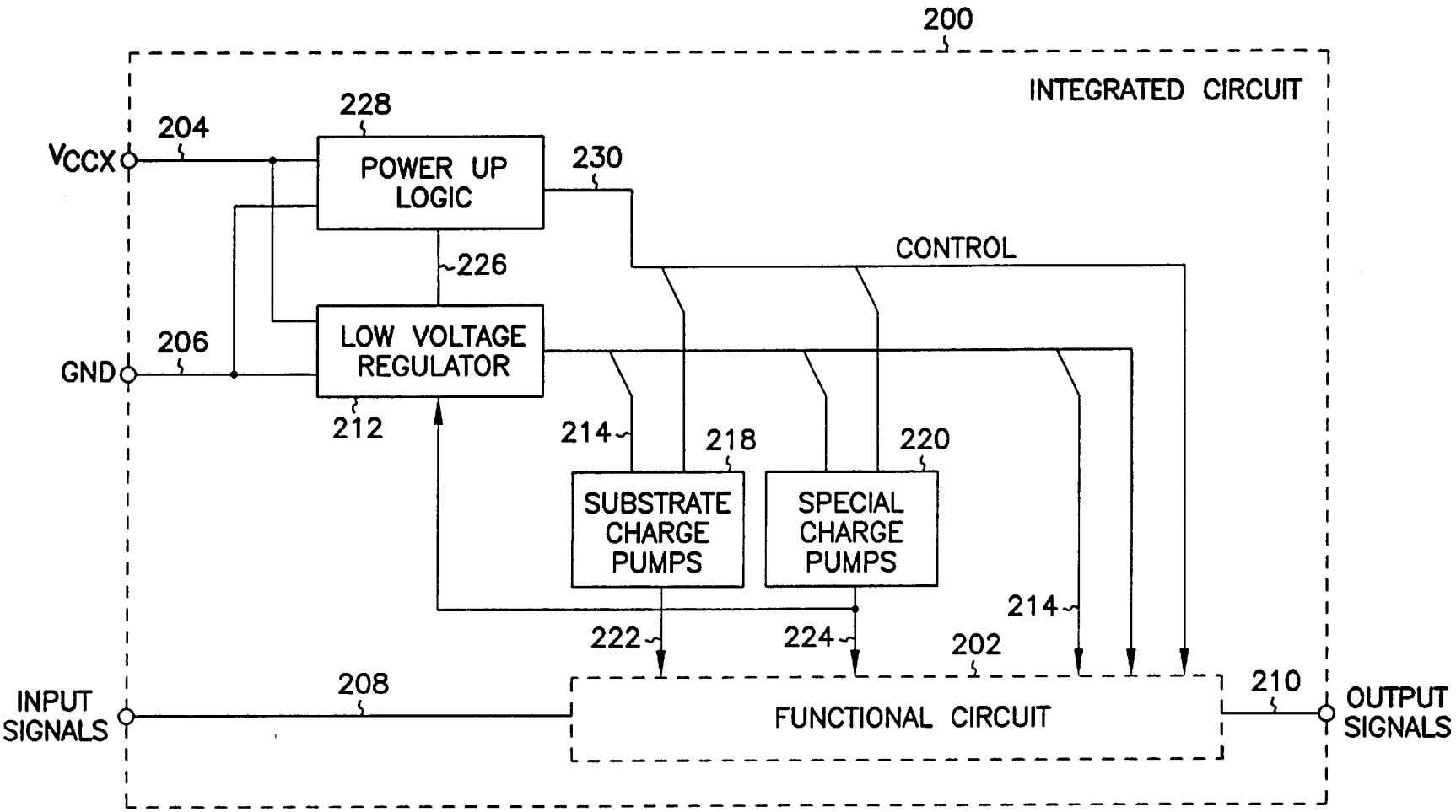
FIG. 2 is a block diagram of an embodiment of an integrated circuit according to the teachings of the present invention.

FIG. 2 is a block diagram that represents an integrated circuit, indicated generally at 200, including a low voltage regulator constructed according to the teachings of the present invention. Integrated circuit 200 includes conventional electrical circuit functions shown generally as functional circuit 202, connections for power signals 204 ($V_{CCX}$), ground conductor 206 (GND), an input shown generally as input signals 208 and an optional output shown generally as output signals 210. As shown, functional circuit 202 uses power and control signals for initialization and operation.

Integrted circuit 200 provides regulated power signals for functional circuit 202 using power signals 204. Voltages of power signals, for example, $V_{CCX}$ are conventionally measured relative to a reference signal for example, ground. Low voltage regulator 212 provides power signals 214, coupled to functional circuit 202, and coupled as required to substrate charge pumps 218 and special charge pumps 220. Substrate charge pumps 218 and special charge pumps 220, which are conventional, respectively provide power signals 222 and 224, which are coupled to functional circuit 202.

Low voltage regulator 212 receives power and control signals 226 provided by power-up logic 228. Regulator 212 may also regulate elevated voltages or current. Control signals 226 enable and govern the operation of low voltage regulator 212. Similarly, control signals 230, provided by power-up logic 228, enable and govern the operation of substrate charge pumps 218 and special charge pumps 220. The sequence of enablement of these several functional blocks depends on the circuitry of each functional block and upon the power of signal sequence requirements of functional circuit 202.

Functional circuit 202 performs an electrical function of integrated circuit 200. In various embodiments, functional circuit 202 is an analog circuit, a digital circuit, or a combination of analog and digital circuitry. Although embodiments of the present invention are effectively applied where functional circuit 202 includes a dynamic random access memory (DRAM), a static random access memory (SRAM), or a video random access memory (VRAM having a serial port, the teachings of the present invention can be advantageously applied to a number of other integrated circuits requiring an internal power voltage regulator.

The conventional dynamic random access memory includes an array of storage cells. In embodiments of the present invention, accessing the array for read, write, or refresh operations is accomplished with circuitry powered by voltages having magnitudes that may be different from the voltage magnitude of signal $V_{CCX}$. These additional voltages are developed from voltage regulator 212.

Power to be applied to functional circuit 202 is conventionally regulated to permit use of integrated circuit 200 in systems providing power that, otherwise, would be insufficiently regulated for proper operation of functional circuit 202. Low voltage regulator 212 includes a voltage reference and regulator circuit (not shown) having sufficient regulated output to supply signal $V_{CCR}$, part of power signals 214.

Power signals 224 are coupled to an input of low voltage regulator 212 so as to allow power signals such as $V_{CCR}$ to track increases in the voltage $V_{CCX}$ at low voltages as the voltage $V_{CCX}$ increases toward a normal operating voltage. The use of the power signals 224 from special charge pumps 220 allows an n-channel transistor to be used as the output stage of low voltage regulator 212 without $V_{CCX}$ trailing $V_{CCX}$ at low voltages.

Figure 3:
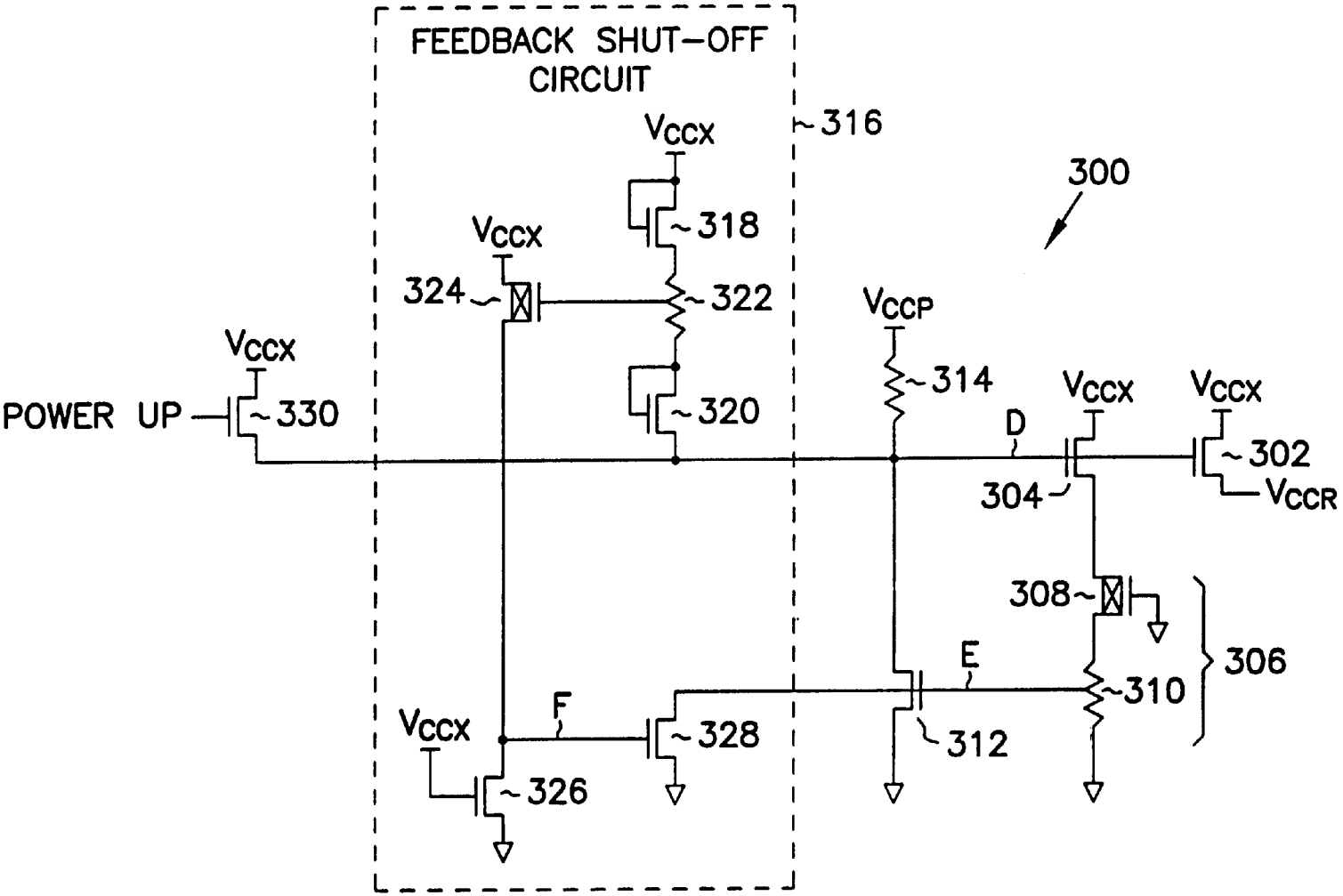
FIG. 3 is a schematic diagram of an embodiment of a voltage regulator according to the teachings of the present invention.

FIG. 3 is a schematic diagram of an embodiment of a voltage regulator circuit, indicated generally at 300, and constructed according to the teachings of the present invention. Regulator 300 includes n-channel transistor 302. Transistor 302 provides an output signal for regulator 300 at a first source/drain region. A second source/drain region of transistor 302 is coupled to the external power supply, $V_{CCX}$. regulator 300 further includes n-channel transistor 304 with a gate that is coupled to the gate of transistor 302 at node D. A first source/drain region of transistor 304 is coupled to $V_{CCX}$. Additionally, a second source/drain region of transistor 304 is coupled to level sensing circuit 306.

Level sensing circuit 306 includes p-channel transistor 308 and voltage divider circuit 310. A first source/drain region of transistor 308 is coupled to the second source/drain of transistor 304. The gate of transistor 308 is coupled to ground. Voltage divider 310 is coupled between a second source/drain region of transistor 308 and ground potential. An output of voltage divider 310 is coupled to a gate of transistor 312 at node E. Transistor 312 is coupled to provide feedback control of node D at the gates of transistors 302 and 304. A first source/drain region of transistor 312 is coupled to ground. A second source/drain region of transistor 312 is coupled to node D.

A charged voltage supply, $V_{CCP}$, is coupled to node D through resistor 314. Advantageously, by applying the charged voltage to resistor 314, regulator 300 overcomes the lag between $V_{CCX}$ and $V_{CCR}$ at low voltage. The charged voltage supply forces the voltage at node D to a level above $V_{CCX}$ at low voltages so as to overcome the threshold voltage drop of transistor 302 and allow $V_{CCR}$ to be maintained at or near the voltage level of $V_{CCX}$. However, in this embodiment, $V_{CCP}$ is derived from $V_{CCR}$. Initially, $V_{CCR}$ lags behind $V_{CCX}$ until the charge pump starts to operate, e.g., at $V_{CCX}$ equal to approximately 3 of 4 volts.

Regulator 300 further includes feedback shut-off circuit 316. Feedback shut-off circuit 316 includes n-channel transistors 318, 320, and voltage divider 322. Transistors 318 and 320 are coupled in a diode configuration that prevents current from flowing to the external power supply $V_{CCX}$ when the charged voltage $V_{CCP}$ is above the external supply voltage. Transistors 318 and 320 also shift the level of the voltage at the output of voltage divider 322 so as to set the voltage at which feedback shut-off circuit 316 shuts off the feedback path as described in more detail below. Voltage divider 322 is coupled between diode coupled transistors 318 and 320. Transistor 320 is coupled to node D.

Circuit 316 further includes p-channel transistor 324. A first source/drain region of transistor 324 is coupled to $V_{CCX}$. A gate of transistor 324 is coupled to an output of voltage divider 322.

Circuit 316 further includes n-channel transistors 326 and 328. Transistor 326 is a long-L transistor. A gate of transistor 326 is coupled to the external power supply $V_{CCX}$. Additionally, a first source/drain region of transistor 326 is coupled to ground and a second source/drain region of transistor 326 is coupled to the second source/drain region of transistor 324 at node F. A gate of transistor 328 is also coupled to node F. A first source/drain region of transistor 328 is coupled to ground and a second source/drain region of transistor 328 is coupled to the gate of transistor 312 at node E.

Regulator 300 also includes transistor 330 which is coupled to receive a POWER UP control signal at a gate of transistor 330. A first source/drain region of transistor 330 is coupled to $V_{CCX}$ and a second source/drain region of transistor 330 is coupled to node D.

Figure 4:
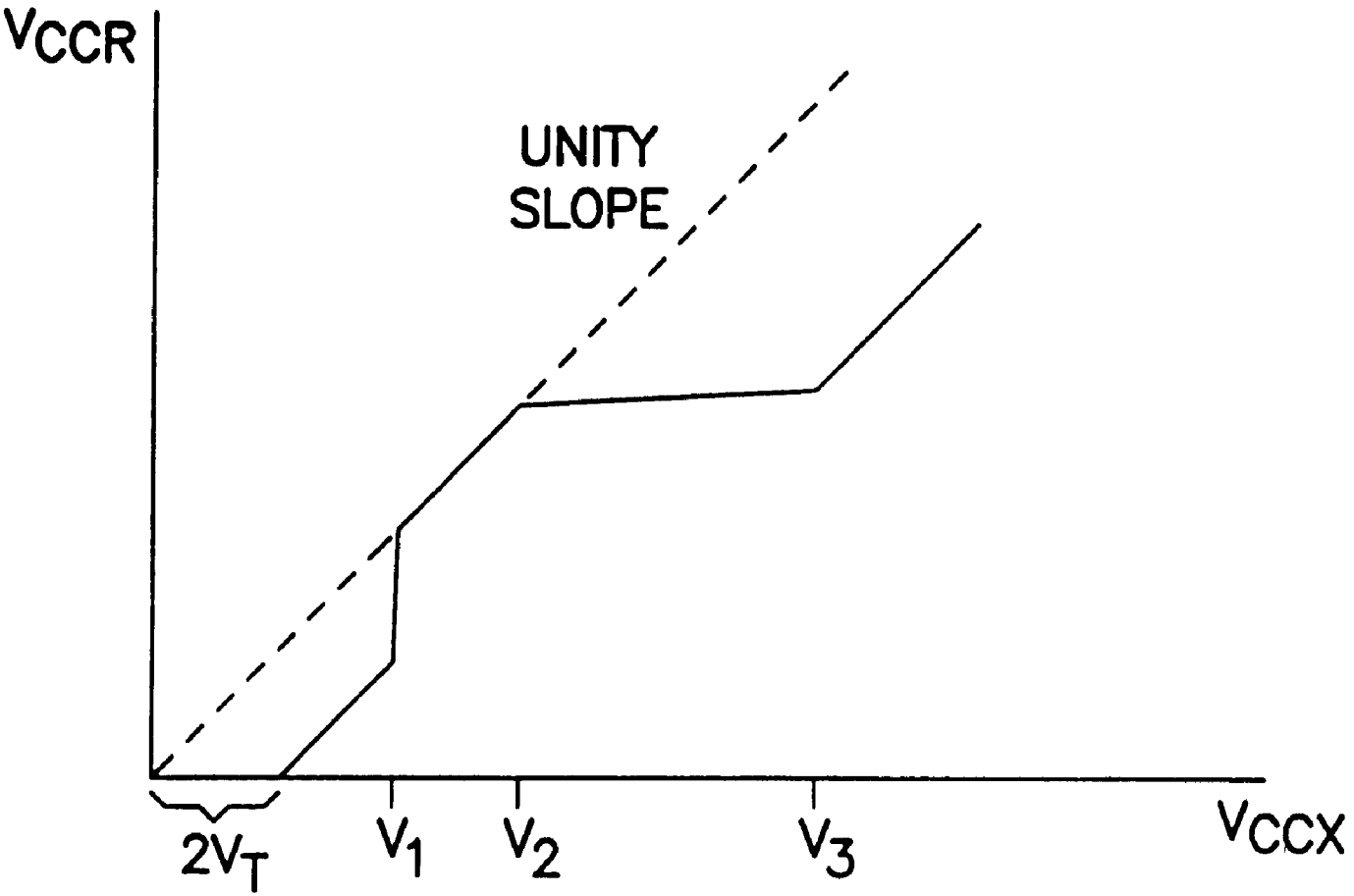
FIG. 4 is a graph that illustrates the relationship between $V_{CCR}$ and $V_{CCX}$ for an embodiment of the present invention.

The operation of regulator 300 is described in conjunction with the graph shown in FIG. 4. Initially, the external voltage $V_{CCX}$ is at zero volts. Regulator 300 maintains an output of approximately zero volts until the external voltage $V_{CCX}$ reaches approximately a level equal to 2 threshold voltages, $V_T$, of a n-channel transistor. At this point, the signal POWER UP provided to transistor 330 turns on transistor 330 and the voltage $V_{CCR}$ output by transistor 302 begins to increase with the external voltage $V_{CCX}$.

The external voltage $V_{CCX}$ continues to increase. When the external voltage reaches the level $V_1$, e.g., 3 or 4 volts, the charge pump that generates $V_{CCP}$ begins to operate and the voltage at node D is brought up to a voltage level above $V_{CCX}$. Thus, the output of transistor 302 rises up to a level approximately equal to the voltage $V_{CCX}$. This voltage level is maintained as $V_{CCX}$ increases up to the voltage $V_2$, e.g., 5 volts. Once $V_{CCX}$ exceeds voltage $V_2$, level sensing circuit 306 and feedback transistor 312 are used to allow $V_{CCR}$ to increase, at most, at a rate with only a very small, selected slope.

When the voltage $V_{CCX}$ reaches the value $V_3$, regulator 300 enters burn-in mode. At this point, sufficient current passes through voltage divider 322 so as to turn on transistor

324. Since transistor 326 is a long-L device, transistor 324 overcomes the effect of transistor 326 and pulls node F to a high potential so as to turn on transistor 328. Transistor 328 imposes a low voltage, e.g., ground, on node E, thus turning off the feedback control of regulator 300 which allows the output of transistor 302 to track increases in the external power supply $V_{CCX}$.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention For example, the value of the voltage used for $V_{CCP}$ can be varied so as to establish a specified relationship between $V_{CCX}$ and $V_{CCR}$ at low voltage. $V_{CCP}$ could be derived from sources other than $V_{CCR}$. Further, the output of regulator 300 can be taken from transistor 304 or transistor 302.

What is claimed is:

1. A method for regulating a voltage, the method comprising:

receiving an unregulated input voltage at a source/drain region of an n-channel transistor;

driving the n-channel transistor with a pumped voltage level so that an output of the n-channel transistor substantially matches the voltage of the unregulated input voltage over a selected voltage range;

regulating the output of the n-channel transistor through a feedback path, wherein regulating the output includes sensing the output of the n-channel transistor and using the sensed output of the n-channel transistor to control a voltage level of a gate of the n-channel transistor; and overriding the feedback path when the output of the n-channel transistor exceeds a selected level.

2. The method of claim 1, further comprising:

increasing the voltage level of the unregulated input voltage; and when the voltage level of the unregulated input voltage reaches a first level, generating the pumped voltage from an output of the n-channel transistor.

3. The method of claim 1, wherein overriding the feedback path comprises generating a signal that reduces the effect of the feedback path from a gate of the n-channel transistor.

4. The method of claim 3, wherein overriding the feedback path comprises overriding the feedback path using a p-channel transistor having a gate coupled to an output of a voltage divider and a first source/drain region coupled to the unregulated input voltage.

5. The method of claim 4, and further comprising:

increasing the voltage level of the unregulated voltage; and when the voltage level of the unregulated input level reaches a second level, thereby turning off a transistor in the feedback path with the p-channel transistor.

6. A method for regulating a voltage, the method comprising:

receiving an unregulated input voltage at a source/drain region of a first n-channel transistor;

driving a second n-channel transistor and the first n-channel transistor with a pumped voltage level so that an output of the first n-channel transistor substantially matches the voltage of the unregulated input voltage over a selected voltage range; and regulating the output of the first n-channel transistor through a feedback path.

7. The method of claim 6, and further comprising:

increasing the voltage level of the unregulated input voltage; and when the voltage level of the unregulated input voltage reaches a first level, generating the pumped voltage from an output of the first n-channel transistor.

8. The method of claim 6, and further comprising overriding the feedback path when the output of the first n-channel transistor exceeds a selected level.

9. The method of claim 8, wherein overriding the feedback path comprises overriding the feedback path using a p-channel transistor having a gate coupled to an output of a voltage divider and a first source/drain region coupled to the unregulated input voltage.

10. The method of claim 9, and further comprising:

increasing the voltage level of the unregulated voltage; and when the voltage level of the unregulated input level reaches a second level, thereby turning off a transistor in the feedback path with the p-channel transistor.

11. The method of claim 6, wherein regulating the output includes sensing the output of the second n-channel transistor and using the sensed output of the second n-channel transistor to control a voltage level of a gate of the first n-channel transistor and a gate of the second n-channel transistor.

12. The method of claim 8, wherein overriding the feedback path comprises generating a signal that reduces the effect of the feedback path from a gate of the second n-channel transistor.

13. An memory device, comprising:

a memory circuit;

a pumped voltage circuit; and a voltage regulation circuit that receives an unregulated input voltage and provides a regulated output voltage to the memory circuit, the voltage regulation circuit including an n-channel transistor with a control gate that is coupled to a pull-down circuit in a feedback loop and a pull-up circuit that is driven by a voltage from the pumped voltage supply so as to allow the regulated voltage to match the level of the input voltage over a range of voltage levels.

14. The memory device of claim 13, wherein the voltage regulator includes a feedback shut-off circuit coupled to the control gate of the pull-down circuit.

15. The memory device of claim 13, wherein the pull-down circuit comprises an n-channel transistor and the pull-up circuit comprises a resistor coupled between the pumped voltage supply and the gate of the n-channel transistor.

16. The memory device of claim 13, wherein the pumped voltage supply is coupled to the output of the regulator so as to generate a pumped voltage level based on the regulated voltage level.

17. The memory device of claim 13, wherein the memory circuit is a dynamic random access memory circuit.

18. An integrated circuit, comprising:

a functional circuit;

a pumped voltage supply; and a voltage regulator circuit, wherein the voltage regulator circuit includes:

an n-channel transistor having a gate and having a source/drain region that provides an output signal for the regulator circuit;

a pull-up device coupled between a pumped voltage supply and the gate of the n-channel transistor;

a pull-down device coupled between the gate of the n-channel transistor and ground potential; and a level sensing circuit, that is responsive to the gate of the n-channel transistor and that generates a signal for a control input of the pull-down device to provide feedback control of the n-channel transistor to regulate the output at the source/drain of the n-channel transistor.

19. The integrated circuit of claim 18, wherein the pull-up circuit comprises a resistor coupled between the pumped power supply voltage and the gate of the n-channel transistor, and wherein the pumped power supply voltage is derived from the output of the n-channel transistor.

20. The integrated circuit of claim 18, wherein the voltage regulator circuit further comprises a feedback shut-off circuit coupled to the control input of the pull-down device so as to turn off the pull-down device when the input voltage exceeds a selected level.

21. The integrated circuit of claim 18, wherein the voltage regulator circuit further comprises a charge pump circuit that derives the pumped voltage from the output of the regulator.

22. The integrated circuit of claim 20, wherein the feedback shut-off circuit includes at least one diode configured transistor that is coupled to inhibit current flow between the pumped voltage supply to the input voltage supply.

23. The integrated circuit of claim 18, wherein the level sensing circuit comprises a voltage divider with an output coupled to the control input of the pull-down device.

24. The integrated circuit of claim 18, wherein the pull-down device comprises an n-channel transistor.

25. A voltage regulator comprising:

means for providing an unregulated input voltage to an n-channel transistor;

means for increasing the voltage level of the unregulated input voltage;

means for generating a pumped voltage from an output of the n-channel transistor, when the voltage level of the unregulated input voltage reaches a first level;

means for driving the n-channel transistor with the pumped voltage level so that an output of the n-channel transistor substantially matches the voltage level of the unregulated input voltage over a selected voltage range; and means for regulating the output of the n-channel transistor through a feedback path.

26. The voltage regulator of claim 25, and further including means for overriding the feedback path when the output of the n-channel transistor reaches a selected level.

27. The voltage regulator of claim 26, wherein the means for regulating the output of the n-channel transistor comprises means for sensing the output of the n-channel transistor and means for using the sensed output of the n-channel transistor to control a voltage level of a gate of the n-channel transistor.

28. The voltage regulator of claim 27, wherein the means for overriding the feedback path comprises generating a signal that disconnects the feedback path from a gate of the n-channel transistor.

29. An integrated circuit comprising:

a functional circuit;

a pumped voltage supply;

a voltage regulation circuit that receives an unregulated input voltage and provides a regulated output voltage to the functional circuit, the voltage regulation circuit includes:

a first n-channel transistor with a control gate and a second n-channel transistor with a control gate, a pull-down device in a feedback loop coupled between the control gates of the first and second n-channel transistors and ground potential; and a pull-up device coupled between the pumped voltage supply and the control gates of the first and second n-channel transistors, wherein the pull-up device is driven by a voltage from the pumped voltage supply so as to allow the regulated voltage to match the level of the input voltage at low voltage levels.

30. The integrated circuit of claim 29, wherein the voltage regulator includes a feedback shut-off circuit coupled to the input of the pull-down device so as to turn off the pull-down device when a voltage level of the input voltage exceeds a selected level.

31. The integrated circuit of claim 29, wherein the pull-down device comprises an n-channel transistor and the pull-up device comprises a resistor.

32. The integrated circuit of claim 29, wherein the pumped voltage supply is coupled to the output of the regulator so as to generate a pumped voltage level based on the regulated voltage level.

33. The integrated circuit of claim 29, wherein the functional circuit comprises a memory device.

34. The integrated circuit of claim 29, wherein the memory device comprises a dynamic access memory device.

35. A voltage regulator, comprising:

an n-channel transistor having a gate and having a source/drain region that provides an output signal for the voltage regulator;

a pull-down device coupled between the gate of the n-channel transistor and ground potential, wherein the pull-down device comprises an n-channel transistor;

a pull-up device coupled between a pumped voltage supply and the gate of the n-channel transistor, wherein the pull-up device comprises a resistor coupled between a pumped power supply voltage and the gate of the n-channel transistor;

a level sensing circuit, that is responsive to the gate of the n-channel transistor and that generates a signal for a control input of the pull-down device to provide feedback control of the n-channel transistor to regulated the output at the source/drain of the n-channel transistor, wherein the level sensing circuit comprises a voltage divider with an output coupled to the control input of the pull-down device;

a feedback shut-off circuit coupled to the control input of the pull-down device so as to turn off the pull-down device when the input voltage exceeds a selected level, wherein the feedback shut-off circuit includes at least one diode configured transistor that is coupled to inhibit current flow between the pumped voltage supply to the input voltage supply; and a charge pump circuit that derives the pumped voltage from the output of the regulator.

36. The voltage regulator of claim 35, wherein the pumped power supply voltage is derived from the output of the n-channel transistor.

* * * * *